United States Patent [19]

Schaeffer

[11] 4,231,528

[45] Nov. 4, 1980

[54] GRINDING MILL SHELL LINER ELEMENTS

[75] Inventor: Bernard J. Schaeffer, Rifle, Colo.

[73] Assignee: Amax Inc., Greenwich, Conn.

[21] Appl. No.: 51,083

[22] Filed: Jun. 22, 1979

[51] Int. Cl.[3] ..... B02C 17/22

[52] U.S. Cl. ..... 241/182; 241/299

[58] Field of Search ..... 241/182, 183, 284, 299

[56] References Cited

U.S. PATENT DOCUMENTS

| | | | |
|---|---|---|---|
| 2,743,060 | 4/1956 | Daman | 241/299 X |
| 3,949,943 | 4/1976 | Schuler et al. | 241/183 |
| 4,046,326 | 9/1977 | Larsen | 241/182 |

FOREIGN PATENT DOCUMENTS

| | | | |
|---|---|---|---|
| 435524 | 10/1926 | Fed. Rep. of Germany | 241/182 |
| 238866 | 9/1925 | United Kingdom | 241/182 |

*Primary Examiner*—Howard N. Goldberg

*Attorney, Agent, or Firm*—Michael A. Ciomek; Eugene J. Kalil

[57] ABSTRACT

A longitudinal metal liner element is provided for lining the interior peripheral wall of a grinding mill. The metal liner element is formed of a plurality of longitudinal segments having inclined end faces such that the segments are cooperably longitudinally arrangeable with the inclined end faces thereof in end-to-end overlapping relationship. The overlapping inclined end faces of the segments are configurated to diverge towards the interior of the mill such that when the segmented liner is secured to the inner peripheral wall of the grinding mill and is subjected to the working stresses of grinding media in the mill, the stresses applied to the metal liner result in the generation of a vertical lifting force at the overlapping end faces due to linear strain along the liner which aids in the subsequent removal of the segments for maintenance purposes.

8 Claims, 9 Drawing Figures

GRINDING MILL SHELL LINER ELEMENTS

This invention relates to a shell liner for rotatable grinding mills, such as semi-autogeneous grinding mills.

BACKGROUND OF THE INVENTION

Grinding mills for grinding crude ore generally comprise a rotatable cylindrical shell made of heavy steel plate and lined on the inside surface thereof with wear resistant shell liners. Lumps of ore are fed into one end of the mill and the ground product removed from the other end. Various types of mills utilize different kinds of grinding media, such as rods, tubes, and balls, to aid in the grinding. Other mills may use the autogeneous grinding method where the ore itself is employed as its own grinding media. In the semi-autogeneous mill, a mixture of ore and steel charge is used as the grinding medium.

The inner peripheral surface of the grinding mill is subjected to a great deal of wear and tear and therefore must be adapted to withstand the continuous impacts and abrasion of ore tumbling in the mill during grinding. To control the movement of the ore in the mill and to protect the steel shell against abrasion and erosion, wear resistant shell liners are mounted onto the inner peripheral surface.

Generally speaking, liner assemblies comprise a plurality of substantially flat liner members supported in cylindrical array by being individually bolted to the inner surface of the grinding mill shell. The liners may be alternately spaced by lift-bars for lifting the ore to the top of the rotating shell or drum from which the ore tumbles by gravity to the bottom where it is crushed or reduced to size by impact. On the other hand, the liners themselves may be configurated with raised rib portions to act as lifters in raising the ore. In semi-autogeneous grinding mills containing grinding media, the lift-bars or ribs similarly raise the grinding media which tumbles to the bottom of the shell and impacts against the ore.

As will be clearly apparent, shell liners are subjected to aggravated wear and tear due to continuous high impact loads and abrasion during the grinding operation, thus requiring periodic replacement of the liners.

As stated hereinbefore, in the grinding of ore large pieces of ore are fed at one end (the feed section) and discharged at the opposite end (the discharge section) in the desired reduced size. Thus, the wear and tear may be greatest during the portion of the grinding cycle where the large ore pieces move from the feed section immediate the end to the intermediate section of the mill. At the entrance end, not much grinding occurs, such that the liners at this end are not subject to the aggravated wear and tear as occur when the large pieces move to the end of the feed section adjacent to the intermediate grinding section of the mill (near the middle of the mill) where the mass lifting and tumbling of the large ore pieces subject the liners at this region of the mill to a great deal of wear. The smaller pieces or particles of ore approaching the discharge section do not provide the same impact against the liner, the reduction of the ore being due substantially to attrition. Thus, less wear occurs near the discharge portion of the mill.

Because of the foregoing mill grinding characteristics, liners of substantially uniform cross section are subjected to non-uniform wear which may require early replacement of worn liner parts and which may result in great scrap loss, especially where the liners are relatively thick along the whole length thereof.

Generally speaking, a shell liner is comprised of a plurality of metal segments (made, for example, of manganese steel) mounted in end-to-end relationship, with their flat ends almost touching, a small gap being generally provided between the ends. Because the liners are subject to great impact as described hereinabove, metal flow occurs along the length of the liner (linear strain), wherein the linear expansion of the liner segments creates great pressure at abutting flat end faces which tends to lock the liner segments in place and makes it difficult to remove them for maintenance purposes.

Examples of various types of shell liners are disclosed in the following U.S. Pat. Nos. 2,993,656; 3,107,867; 3,318,537; 3,582,007; 3,604,637; and 3,802,634.

U.S. Pat. No. 2,993,656, in particular, discloses liners comprised of a plurality of segments positioned in end-to-end relationship with a slight gap between adjacent flat end faces thereof. Such liner segments can lock in place due to linear strain along the length thereof, thus making it difficult to remove the liners for maintenance and repair.

It would be desirable to provide a segmented shell liner design that takes into account the linear strain produced during grinding operations such that the liner segment can be easily removed for shell maintenance purposes.

OBJECTS OF THE INVENTION

It is an object of the invention to provide a segmented shell liner capable of being easily removed from a grinding shell following aggravated wear and tear.

Another object of the invention is to provide a segmented shell liner which has a tapered shape in longitudinal profile and which is characterized by controlled wear along the length thereof with minimum scrap loss.

These and other objects will more clearly appear from the following disclosure and claims taken together with the accompanying drawings.

IN THE DRAWINGS

SUMMARY OF THE INVENTION

Stating it broadly, the invention is directed to a longitudinal metal liner element for lining the interior peripheral wall of a grinding mill, the metal liner element being formed of a plurality of longitudinal segments having at least one inclined end face such that the segments are cooperably longitudinally arrangeable with inclined end faces thereof in end-to-end overlapping relationship. The overlapping inclined end faces of the segments are configurated to diverge towards the interior of the grinding mill such that when the segmented liner element is secured to the inner peripheral wall of the grinding mill and is subjected to the working stresses of grinding media, the stresses applied to the metal liner result in the generation of a vertical lifting force at said overlapping end faces due to linear strain along the liner which aids in the subsequent removal of the liner segments for maintenance purposes. The terminal end faces of the liner may be flat.

In a preferred embodiment, the liner is characterized longitudinally in profile by a feed end section, an intermediate section, and a discharge section. The feed end section is tapered and increases to an optimum thickness as it approaches the intermediate section and maintains said optimum thickness substantially constant for a predetermined length of said feed section, the intermediate section tapering to a smaller thickness from said optimum thickness, the taper continuing along the discharge end of the liner to a predetermined final thickness.

By utilizing a liner with the foregoing profile, the section of maximum thickness is located where grinding by impact is very vigorous and where substantial wearing of the liner occurs. The intermediate and discharge sections taper to a smaller thickness from the maximum thickness where the impact of the ore is not as great since the ore has already been substantially broken up into smaller pieces. Thus, the wear of the liner along a portion of the intermediate section and along all of the discharge section is substantially less than in the region of the feed section.

The liner segment with the maximum thickness where it is needed will wear faster than the other sections, whereby the worn liner ultimately removed will result in less scrap loss than if a liner of uniform thickness were used.

DETAILS OF THE INVENTION

Figures 1, 2, 3, 4, 5, 6, 7:
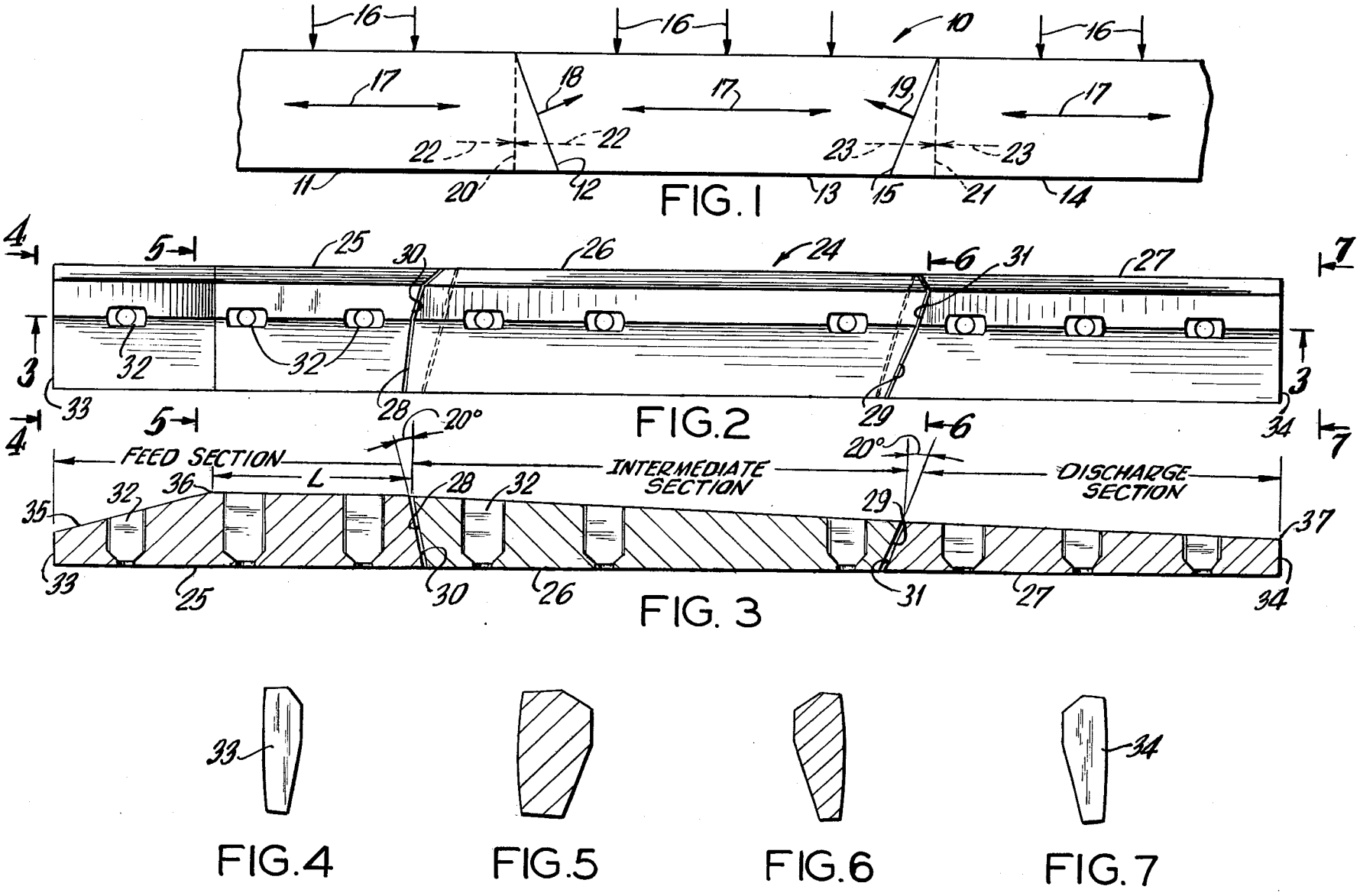
FIG. 1 is a schematic of a shell liner comprising three segments showing the stresses acting on the liner segments during a grinding operation.
FIG. 2 is a plan view of one embodiment of the shell liner of the invention.
FIG. 3 is a longitudinal cross section taken along line 3—3 of FIG. 2 showing the profile contour of one embodiment of the shell liner.
FIGS. 4 to 7 are end views and transverse cross sections of, as viewed in the direction of the arrows along lines 4—4, 5—5, 6—6 and 7—7, respectively, the liner of FIG. 2.

Referring to FIG. 1, a shell liner 10 is shown schematically comprising a partial segment 11 bevelled with an inclined end face 12 and in end-to-end relationship with segment 13 with a corresponding inclined end face, the two end faces being disposed in overlapping relationship. A third partial segment 14 extends longitudinally and coaxially of the second segment, the end face 15 thereof being similarly inclined and coinciding with the corresponding end face of segment 13.

As stated earlier, impact of ore against the liner causes linear strain to occur along the liner (expansion in the longitudinal direction). Referring to FIG. 1, impact stress against the liner is indicated by the arrows 16. This results in linear strain along the liner shown by horizontal arrows 17. The liner grows longitudinally due to the linear strain, thus causing the inclined faces to press against each other, whereby lifting forces 18 and 19, respectively, are created at the inclined faces due to action and reaction tending to loosen and raise segment 13, except for the fact that the liner segments are bolted to the shell. However, when the bolts are removed, the segments tend to loosen and lift away from the shell surface.

On the other hand, if the end faces are flat as shown by dotted lines 20 and 21, linear strain along the liner segments cause opposing horizontal forces 22, 23 to be generated at the flat end faces (right angled faces) which tend to lock the segments in place and render them difficult to disassemble even after the bolts are removed.

One embodiment of the liner of the invention is shown in FIG. 2 which illustrates a three-piece liner 24 comprised of segments 25, 26, and 27. The liner as shown has terminal end faces 33, 34. The opposite end faces 28, 29 of segment 26 are bevelled or inclined to correspond with inclined end face 30 of segment 25 and end face 31 of segment 27 (note also FIG. 3). The inclined end face is preferably designed to make an acute angle of 20° with a vertical axis, the angle ranging from about 10° to 30°, the end faces being generally inclined at the same angle with the longitudinal axis of the line.

The segments are arranged with a small gap between the inclined end faces, with the end faces overlapping each other as shown in FIGS. 2 and 3. The liner is provided with bolt holes 32. The remote end faces of the liner itself are flat as shown at 33 and 34, respectively.

FIG. 3 is a longitudinal cross section taken along line 3—3 of FIG. 2 looking in the direction of the arrows. As will be noted, the inclined end faces 28, 30 and 29, 31 diverge outward from the bottom of the liner or diverge towards the interior of the cylindrical shell when the liner is bolted to the shell (note FIG. 9).

The liner of FIG. 3 is divided into three working sections corresponding to the grinding sections in the mill (note also FIG. 9), to wit: (1) a feed section in which the liner is initially tapered at 35 and increases to a predetermined optimum thickness at 36 which is maintained substantially constant over a predetermined length L; (2) an intermediate section which tapers to a smaller thickness from said optimum thickness; (3) the taper continuing through the discharge section as shown to a predetermined final thickness at 37 at terminal end face 34, the end face being flat.

The aforementioned profile is important in providing liners with low scrap loss following substantially complete use thereof. A particular three-segment liner is one having a total length of 167.27 inches, the initial gaps being included in the length; an optimum thickness of about 10.5 inches of about 28 inches long; an end thickness at the feed end of about 4.5 inches; and an end thickness at the discharge end of about 5.5 inches. The length of the initial taper 35 in plan view is about 22 inches, the length of the taper following the region of uniform cross section in plan view being approximately 117 inches.

The end face 33 of the feed section is shown in FIG. 4. The cross section of optimum thickness of the feed section taken along line 5—5 is shown in FIG. 5. The cross section of the tapered portion at substantially the junction between the intermediate section and the discharge section taken along line 6—6 as shown in FIG. 6, the terminal end face of the discharge section as viewed along line 7—7 being shown in FIG. 7.

Figure 8:
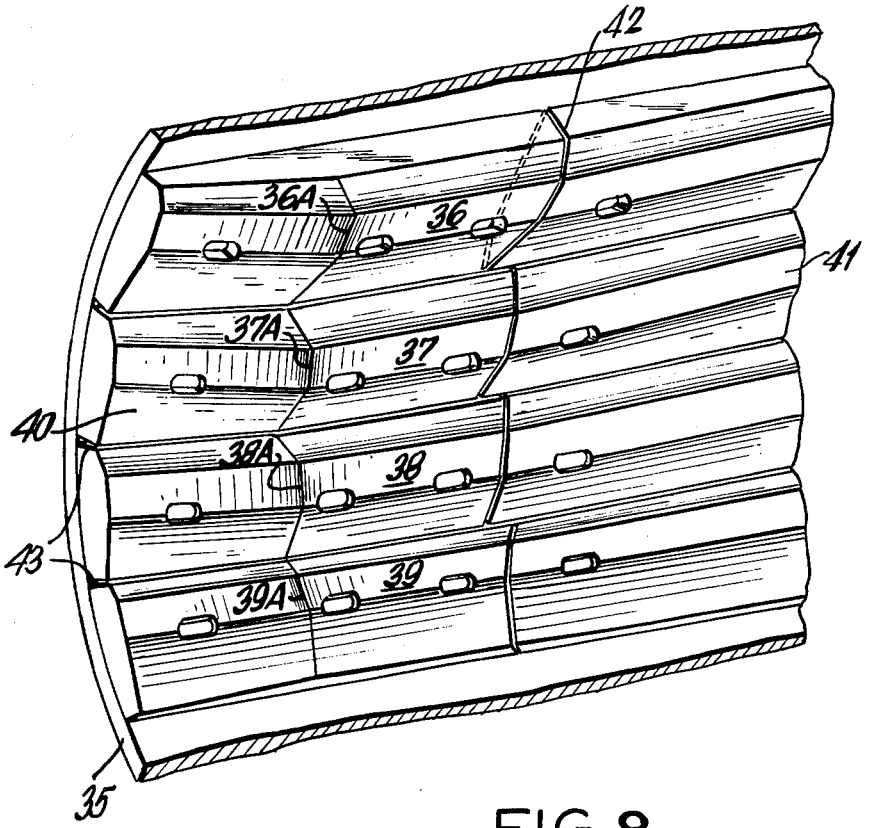
FIG. 8 is a partial section of the inner surface of a grinding shell in three dimensions showing one arrangement of the liners.

A fragment of the inner surface of the grinding shell in three dimensions with the liners bolted in place is shown in FIG. 8, the grinding shell 35A having arranged therein liners 36, 37, 38, and 39 comprising feed section 40 coextensive with a fragment of intermediate section 41, the inclined end faces being separated by a slight gap 42. As will be noted, the liners have an initial taper at feed section 40 which terminates at 36A, 37A, 38A, and 39A of each of the liners.

The liners are nested around the inner periphery of the shell in side-by-side relationship with a slight gap 43 between each of the liners, the liners being fastened to the cylindrical shell by bolts as shown.

Figure 9:
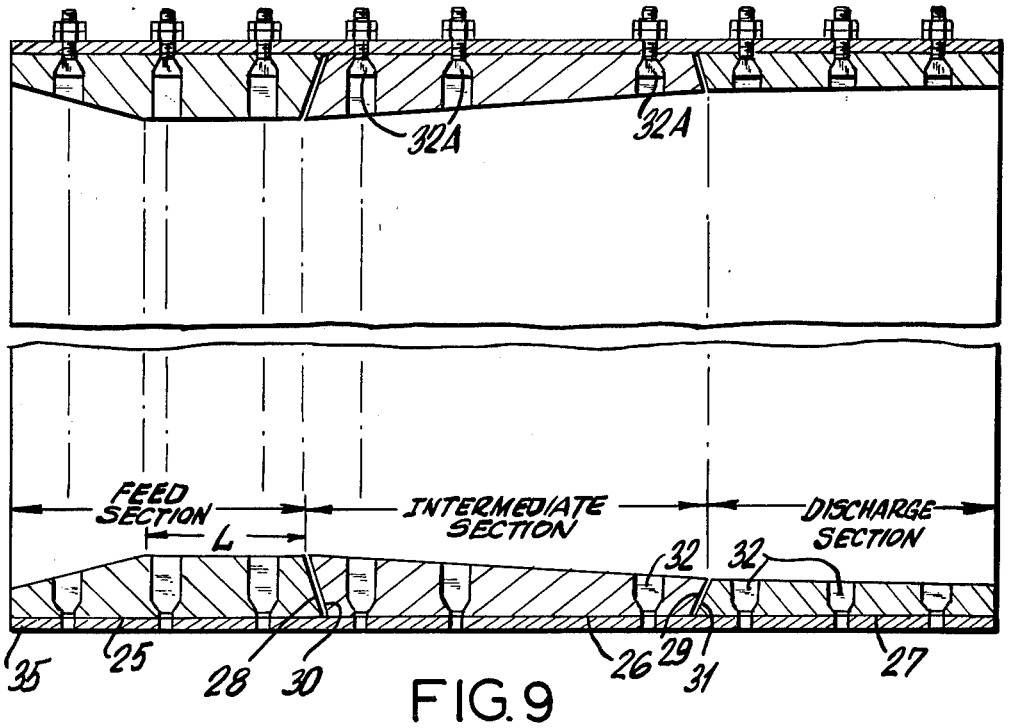
FIG. 9 is a longitudinal cross section of a grinding mill utilizing the liner of the invention.

A cross section of one embodiment of a grinding mill is shown in FIG. 9. As will be noted, the mill comprises a feed section, an intermediate section, and a discharge section, each of the liners being contoured according to each of the sections as described hereinbefore and being secured around the periphery of the mill by bolts 32A.

In addition to the liner, the invention is also directed to a cylindrical grinding mill with a plurality of said liners fastened or secured around the interior peripheral wall thereof, each of said metal liners having terminal end faces and being formed of a plurality of longitudinal segments having at least one inclined end face, said segments being cooperably longitudinally and coaxially arranged on said peripheral wall with the inclined end faces thereof in end-to-end overlapping relationship. Each of the liners are preferably characterized longitudinally in profile by a feed end section, an intermediate section, and a discharge section. The feed end section is tapered and increases to an optimum thickness as it approaches the intermediate section and maintains said optimum thickness for a predetermined length of the feed section, the intermediate section tapering to a smaller thickness from said optimum thickness, the taper continuing through the discharge section to a predetermined final thickness.

The overlapping inclined end faces of the segments of each of the liners are configurated to diverge towards the interior of the mill, whereby when each of said segmented liner is secured to the inner peripheral wall of the grinding mill and is subjected to the working stresses of grinding media in the mill, the stresses applied to the metal liner result in the generation of a vertical lifting force at the overlapping end faces due to linear strain caused by metal flow along each of said liners which aids in the subsequent removal of said segments for maintenance purposes.

The controlled wear profile for an arrangement of liners of a particular metallurgical composition may be determined by measuring the liner thickness weekly at predetermined locations across the length of the mill, for example, at 12 equally spaced locations. In this manner, a wear rate can be established for each location. In the present situation, the units of measure are expressed in inches per day at "X" tons of feed per hour.

Following a particular grinding regime, the final worn out liners are also measured to provide a wear pattern; and based on the final wear profile curve for the liner segments, the wear rates are calculated and a new liner profile created to compensate for the determined wear pattern.

The liner thickness measurement may be determined by employing an ultra sonic thickness tester.

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. A longitudinal metal liner for lining the interior peripheral wall of a grinding mill, said metal liner having a grinding surface and being formed of a plurality of segments comprising a first segment, a second segment and at least a third segment, each segment having at least one inclined end face, at least one segment following said first segment having both end faces inclined such that the angle between said end inclined faces diverges toward the grinding surface of said liner, said segments of the liner being cooperably longitudinally and coaxially arrangeable with the inclined end faces thereof disposed in end-to-end overlapping relationship, whereby when said segmented liner secured to the inner peripheral wall of said grinding mill is subjected to the working stresses of grinding media on the grinding surface of said liner, the stresses applied to the metal liner result in the generation of a vertical lifting force on at least said segment having divergent end faces due to linear strain caused by metal flow along the liner which aids in the subsequent removal of said segmented liner for maintenance purposes.

2. The metal liner of claim 1, wherein the liner is made up of three segments comprising a first segment having a terminal end face at one end and an inclined end face at its other end, a second segment having inclined end faces at both ends which diverge towards the grinding surface of said liner, and a third segment having an inclined end face at one end and a terminal end face at its other end, said second segment being arrangeable longitudinally and coaxially between the first and third segments of each liner with their corresponding inclined end faces in overlapping relationship.

3. The metal liner of claim 1, wherein said liner is characterized longitudinally in profile by a feed end section, an intermediate section, and a discharge section, such that the feed end section is tapered and increases to an optimum thickness as it approaches the intermediate section and maintains said optimum thickness for a predetermined length of said feed section, said intermediate section tapering to a smaller thickness from said optimum thickness, said taper continuing through the discharge section of said liner to a predetermined final thickness.

4. A cylindrical grinding mill having a plurality of longitudinal metal liners fastened around the interior peripheral wall thereof, each of said metal liners having terminal end faces and a grinding surface and being formed of a plurality of segments comprising a first segment, a second segment and at least a third segment, each segment having at least one inclined end face, at least one segment following said first segment having both end faces inclined such that the angle between said inclined end faces diverges towards the grinding surface of each of said liners, the segments of each of said liners being cooperably longitudinally arranged with the inclined end faces thereof disposed in end-to-end overlapping relationship, whereby when each segmented liner secured to the inner peripheral wall of said grinding mill is subjected to the working stresses of grinding media on the grinding surface thereof, the stresses applied to the metal liners result in the generation of a vertical lifting force on at least said segment of each liner having divergent end faces due to linear strain caused by metal flow along each of the liners which aids in the subsequent removal of said segmented liners for maintenance purposes.

5. The cylindrical grinding mill of claim 4, wherein each of the liners is made up of three segments comprising a first segment having a terminal end face at one end and an inclined end face at its other end, a second segment having inclined end faces at both ends which diverge towards the grinding surface of each of said liners, and a third segment having an inclined end face at one end and a terminal end face at its other end, said second segment being arranged longitudinally and coaxially between the first and third segments of each liner with their corresponding inclined end faces in overlapping relationship.

6. The metal liner of claim 4, wherein each of said liners relative to said grinding mill is characterized longitudinally in profile by a feed end section, an intermediate section, and a discharge section, such that the feed end section is tapered and increases to an optimum thickness as it approaches the intermediate section and maintains said optimum thickness for a predetermined length of said feed section, said intermediate section tapering to a smaller thickness from said optimum thickness, said taper continuing through the discharge section of said liner to a predetermined final thickness.

7. A cylindrical grinding mill having a plurality of longitudinal metal liners fastened around the interior peripheral wall thereof, each of said metal liners having terminal end faces and a grinding surface and being formed of a plurality of segments comprising a first segment, a second segment and at least a third segment, each segment having at least one inclined end face, at least one segment following said first segment having both end faces inclined such that the angle between said inclined end faces diverges towards the grinding surface of each of said liners, the segments of each of said liners being cooperably longitudinally arranged with the inclined end faces thereof disposed in end-to-end overlapping relationship, each of said liners relative to said grinding mill being characterized longitudinally in profile by a feed end section, an intermediate section, and a discharge section, such that the feed end section is tapered and increases to an optimum thickness as it approaches the intermediate section and maintains said optimum thickness for a predetermined length of said feed section, said intermediate section tapering to a smaller thickness from said optimum thickness, said taper continuing through the discharge section of said liner to a predetermined final thickness, whereby when each segmented liner secured to the inner peripheral wall of said grinding mill is subjected to the working stresses of grinding media in the mill on the grinding surface thereof, the stresses applied to the metal liners result in the generation of a vertical lifting force on at least said segment of each liner having divergent end faces due to linear strain caused by metal flow along each of said liners which aids in the subsequent removal of said segmented liners for maintenance purposes.

8. The cylindrical grinding mill of claim 7, wherein each of the liners is made up of three segments comprising a first segment having a terminal end face at one end and an inclined end face at its other end, a second segment having inclined end faces at both ends which diverge towards the grinding surface of each of said liners, and a third segment having an inclined end face at one end and a terminal end face at its other end, said second segment being arranged longitudinally and coaxially between the first and third segments of each liner with their corresponding inclined end faces in overlapping relationship.

* * * * *